US005830117A

United States Patent [19]

Anderson

[11] Patent Number: 5,830,117

[45] Date of Patent: Nov. 3, 1998

[54] TORQUE CONTROL FOR CONTINUOUS MOTION BAG MACHINE

[75] Inventor: Danford C. Anderson, Green Bay, Wis.

[73] Assignee: FMC Corporation, Chicago, Ill.

[21] Appl. No.: 523,737

[22] Filed: Sep. 5, 1995

[51] Int. Cl.[6] ..... B31B 1/64

[52] U.S. Cl. ..... 493/193; 493/196; 493/197; 493/198

[58] Field of Search ..... 493/3, 8, 29, 205, 493/206, 208, 190, 193, 194, 195, 196, 197, 198

[56] References Cited

U.S. PATENT DOCUMENTS

| | | | |
|---|---|---|---|
| 3,607,550 | 9/1971 | Ballanger et al. | 156/358 |
| 3,650,873 | 3/1972 | Smith et al. | 156/465 |
| 3,663,338 | 5/1972 | Wech | 156/515 |
| 3,921,043 | 11/1975 | Luzio | 318/7 |
| 4,545,844 | 10/1985 | Buchanan | 156/515 |
| 4,650,451 | 3/1987 | Herrington | 493/190 |
| 4,702,731 | 10/1987 | Lambrecht | 493/196 |
| 5,092,832 | 3/1992 | Crowley | 493/421 |
| 5,135,460 | 8/1992 | Feustel | 493/1 |
| 5,230,688 | 7/1993 | Hatchell | 493/193 |
| 5,417,638 | 5/1995 | Anderson et al. | 493/11 |
| 5,447,486 | 9/1995 | Anderson et al. | 493/11 |
| 5,555,610 | 9/1996 | Young | 26/96 |

FOREIGN PATENT DOCUMENTS

| | | |
|---|---|---|
| 220329 | 3/1991 | Japan . |
| 3124507 | 5/1991 | Japan . |
| 322248 | 4/1993 | Japan . |
| 109939 | 5/1995 | Japan . |
| 1363845 | 8/1974 | United Kingdom . |

*Primary Examiner*—Jack W. Lavinder
*Attorney, Agent, or Firm*—Rockey, Milnamow & Katz, Ltd.

[57] ABSTRACT

There is provided a torque control assembly for use on a continuous motion bag machine comprising torque driven means and a drive for driving a motor wherein the torque driven means is operatively connected to the motor for lowering a tension in a web prior to the web entering a sealing assembly on the bag machine. There is also provided a continuous motion bag machine comprising the torque control assembly.

11 Claims, 1 Drawing Sheet

TORQUE CONTROL FOR CONTINUOUS MOTION BAG MACHINE

BACKGROUND OF THE INVENTION

1. Field of the Invention

This invention relates to plastic bag fabricating machines and more particularly to systems for controlling the flow of film.

2. Description of Related Art

Film may be provided to a sealing drum for sealing individual plastic bags to be formed. For example, the sealing drum may contain two sealing bars diametrically opposed in the sealing drum. The sealing drum may be cradled in a sealing blanket, with the web of film for forming individual plastic bags disposed between the sealing drum and the sealing blanket. The sealing drum may rotate in a given direction, providing, for example, two seals of the web in a direction transverse to the web path for each rotation of the sealing drum. The sealing bar may press the film against the blanket for the time period in which the web is disposed between the blanket and a given sealing bar. Thus, the sealing bars may seal a web of film corresponding to the ends of a given plastic bag being formed.

The film is provided to the sealing drum at a relatively high tension level. This is due to the fact that conventional dancer rolls and nip rolls disposed before the sealing drum provide a high drag in the film. When this occurs, the seal made by the sealing drum may not always be good, resulting in a faulty plastic bag. It is therefore desirable to have a bag making machine which provides a lower film tension at a location prior to the sealing drum.

SUMMARY OF THE INVENTION

There is provided a torque control assembly for controlling the flow of a web of material comprising torque driven means and a drive for driving a motor wherein the torque driven means is operatively connected to the motor for lowering a tension in the web in a region prior to where the web is sealed.

There is also provided a torque control assembly for use on a continuous motion bag machine comprising torque driven means and a drive for driving a motor wherein the torque driven means is operatively connected to the motor for lowering a tension in a web prior to the web entering a sealing assembly on the bag machine.

There is further provided a continuous motion bag machine comprising a sealing assembly and a torque control assembly, the torque control assembly being disposed upstream from the sealing assembly and comprising torque driven means and a drive for driving a motor wherein the torque driven means is operatively connected to the motor for lowering a tension in a web prior to the web entering a sealing assembly on the bag machine.

DESCRIPTION OF THE PREFERRED EMBODIMENTS

Figure 1:
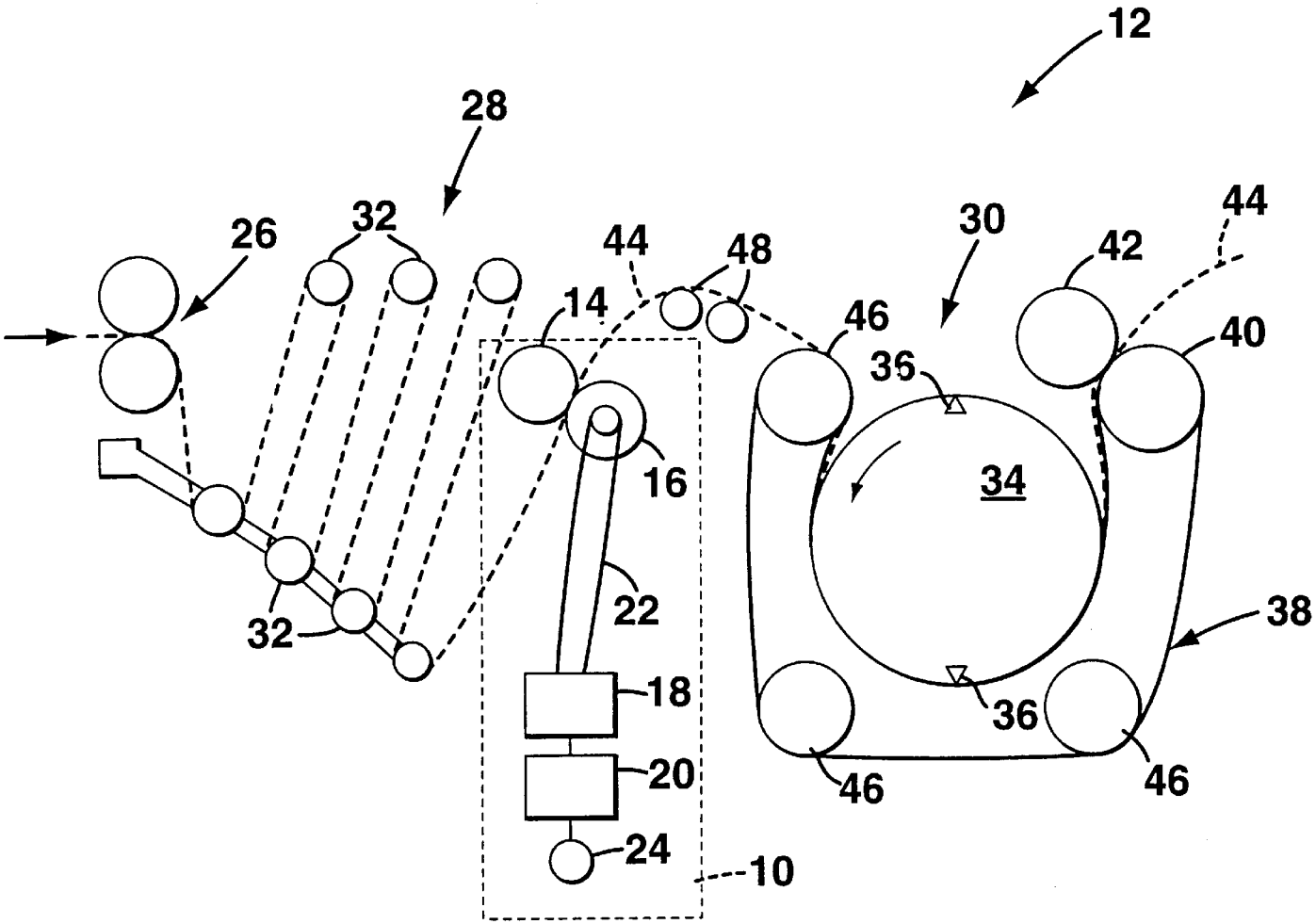
FIG. 1 is an end view of the torque control assembly of the present invention and its cooperation with various components of a bag making machine.

Referring to FIG. 1, there is provided a torque control assembly 10 for use on a continuous motion bag machine 12. The torque control assembly 10 comprises torque driven means such as torque driven rolls 14 and 16, a motor 18, and a drive 20. The torque control assembly 10 further comprises a connecting means 22. The connecting means 22, which is preferably a timing belt, may be any suitable means for operatively connecting roll 16 to the motor 18. Roll 16 may be the driving roll and roll 14 may be the driven roll. Although the timing belt 22 is shown to connect between roll 16 and the motor, the timing belt 22 may instead be connected to roll 14.

The motor 18 may, for example, be a DC motor, such as a one horsepower motor manufactured by Reliance Electric Corporation. Further, the drive 20 may, for example, be a DC Torque Drive Series R400 manufactured by Danfoss Electronic Drives, a division of Danfoss, Inc. However, the drive 20 may be any DC, AC, or servo torque drive and the motor may be any DC, AC, or servo motor.

The torque control assembly 10 may further comprise a torque setting control 24 which may be connected to the control inputs of the drive 20. The torque setting control 24 is preferably a potentiometer, such as a ten turn, five K-Ohm, one quarter watt potentiometer. The potentiometer 24 provides a variance in how much force or torque the motor 18 provides to the rolls 14 and 16. Alternatively, the torque setting control 24 may be any process level input device such as load cells. A load cell may, for example, be placed before and after the torque driven rolls 14 and 16 to sense the tension in the web 44 and activate the motor 18 when too large of a tension is placed on the web 44.

The torque control assembly 10 may, for example, be disposed between a pair of nip rolls 26 and dancer assembly 28 at one end and a sealing assembly 30 at an opposing end. The nip rolls 26 can be speed controlled infeed nip rolls. The dancer assembly 28 may comprise a plurality of conventional dancer rolls 32. The sealing assembly 30 may comprise a sealing drum 34 having a pair of sealing bars 36 at diametrically opposed ends and a sealing blanket 38. The sealing assembly 30 may further comprise a driving roll 40 for driving the sealing blanket 38, an idler roll 42 to forward or retard the web 44, and a plurality of idler rolls 46 which help support the sealing blanket 38. A plurality of guide rolls 48 may also be disposed between the torque control assembly 10 and the sealing assembly 30.

The sealing drum 34 may be a conventional drum floating on an axle, not shown. The sealing drum 34 may, for example, rotate in a counterclockwise manner due to the force of the sealing blanket 38 against the sealing drum 34, the web of plastic film 44 being disposed between the sealing drum 34 and the sealing blanket 38. That is, the driving roll 40 may drive the sealing blanket 38 in a clockwise manner which, in turn, causes the sealing drum 34 to rotate in a counterclockwise manner.

In operation, the web 44 of plastic film is provided from a standard film supply to the pair of nip rolls 26 and to the dancer assembly 28. The web of film 44 is disposed between the torque driven rolls 14 and 16 of the torque control assembly 10. The web 44 is further provided to the sealing assembly 30. In the sealing assembly 30, the web 44 is disposed between the sealing drum 34 and the sealing blanket 38.

The web 44 of plastic film is continuously provided to the sealing assembly 30. When the potentiometer 24 is set to zero, the motor 18 may not provide any force to help the flow of the web 44 to reduce the tension in the web in the region prior to entering the sealing assembly 30. The potentiometer 24 setting may gradually be increased such that there is little or no tension in the web 44 in the region prior to entering the sealing assembly 30. That is, when the potentiometer 24 setting is gradually increased, the drive 20 drives the motor 18 at a faster rate. This, in turn, drives the torque driven rolls 14 and 16 at a faster rate via timing belt 22. As a result, the tension in the web 44 at the output of the torque control assembly 10 lessens. By further increasing the potentiometer 24 setting, the tension in the web 44 at an output of the torque control assembly 10 may further lessen such that there is little or no tension at the output of the torque control assembly 10.

The web 44 may move, for example, one hundred to seven hundred feet per minute in the bag making machine 12. The tension may be reduced to approximately zero pounds per linear inch by employing the torque control assembly 10.

The bag machine, may, for example, be an FMC continuous motion bag machine model number RB1300 which has been modified to include the torque control assembly 10 disposed between the dancer assembly 28 and the sealing assembly 30. The torque driven rolls 14 and 16 may, for example, be identical in construction to standardly used infeed nip rolls.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. A continuous motion bag machine for forming bags from a bag-wall-forming web, comprising;

a sealing assembly; and a torque control assembly, said torque control assembly being disposed upstream from said sealing assembly, said torque control assembly comprising torque driven rolls, a motor, and a drive for driving said motor;

wherein said torque driven rolls are operatively connected to said motor and in moving contact with said web for lowering tension in said web prior to said web entering said sealing assembly on said bag machine.

2. The bag machine of claim 1 wherein said torque driven rolls are operatively connected to said motor by a timing belt.

3. The bag machine of claim 1 further comprising a torque setting control connected to said drive.

4. The bag machine of claim 3 wherein said torque setting control comprises a potentiometer.

5. The bag machine of claim 3 wherein said torque setting control comprises a load cell.

6. A continuous motion bag machine, comprising:

a pair of coacting, infeed nip rolls;

a speed control drive means for driving said nip rolls;

a dancer roll assembly located downstream of said speed controlled infeed nip rolls, said dancer roll assembly including a plurality of rolls for receiving the web in a serpentine fashion, said dancer roll assembly for holding a supply length of web;

a pair of torque control rolls, located downstream of said dancer roll assembly;

a motor drive for said torque control rolls, said motor drive operatively connected to said torque control rolls to output a constant torque to the web at variable speeds of said torque control rolls;

a sealing assembly located downstream of said torque control rolls for sealing the web at intermittent positions along its length, said sealing assembly including a rotating sealing drum with sealing bars on an outer perimeter thereof, and a sealing blanket for partially wrapping said seal drum and pressing said web to a surface of said sealing drum.

7. The bag according to claim 6, wherein said torque motor drive includes a motor having a rotary output connected by a drive belt to one of said torque control rolls and a drive control connected to said motor for setting a constant torque output of said motor.

8. The of claim 6 wherein said torque control rolls are operatively connected to said motor drive by a timing belt.

9. The machine of claim 6 further comprising a torque setting control connected to said drive.

10. The assembly of claim 9 wherein said torque setting control comprises a potentiometer.

11. The assembly of claim 9 wherein said torque setting control comprises a load cell.

* * * * *

UNITED STATES PATENT AND TRADEMARK OFFICE

CERTIFICATE OF CORRECTION

PATENT NO. : 5,830,117

DATED : November 3, 1998

INVENTOR(S) : Danford C. Anderson

It is certified that error appears in the above-identified patent and that said Letters Patent is hereby corrected as shown below:

At column 4, line 30, after "bag" insert --machine--.
At column 4, line 35, after "The" insert --machine--.
At column 4, line 39, replace "assembly" with --machine--.
At column 4, line 41, replace "assembly" with --machine--.

Signed and Sealed this

Eighth Day of June, 1999

*Attest:*

Q. TODD DICKINSON

*Attesting Officer*

*Acting Commissioner of Patents and Trademarks*